US007642030B2

(12) United States Patent
Nomiya et al.

(10) Patent No.: US 7,642,030 B2
(45) Date of Patent: Jan. 5, 2010

(54) TONER, MANUFACTURING METHOD THEREOF AND IMAGE FORMING METHOD

(75) Inventors: Makoto Nomiya, Tokyo (JP); Mikio Koyama, Kunitachi (JP); Meizo Shirose, Hachioji (JP); Kenji Hayashi, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 387 days.

(21) Appl. No.: 11/105,893

(22) Filed: Apr. 14, 2005

(65) Prior Publication Data

US 2006/0029876 A1 Feb. 9, 2006

(30) Foreign Application Priority Data

Aug. 9, 2004 (JP) ..... 2004-231969

(51) Int. Cl.
*G03G 9/093* (2006.01)

(52) U.S. Cl. ..... 430/109.3; 430/109.1; 430/111.4

(58) Field of Classification Search ..... 430/109.1, 430/109.3, 111.4
See application file for complete search history.

(56) References Cited

U.S. PATENT DOCUMENTS

| | | | | |
|---|---|---|---|---|
| 5,567,567 | A * | 10/1996 | Akiyama et al. | 430/110.2 |
| 5,733,700 | A * | 3/1998 | Asano et al. | 430/109.1 |
| 6,342,328 | B1 * | 1/2002 | Takasaki et al. | 430/108.22 |
| 2002/0039699 | A1 * | 4/2002 | Nishimori et al. | 430/137.11 |
| 2005/0095516 | A1 * | 5/2005 | Ohmura et al. | 430/45 |

OTHER PUBLICATIONS http://www.sigmaaldrich.com/catalog/search/SearchResultsPage/Expand, Jul. 16, 2007 Sigma Aldrich Product Information.*

* cited by examiner

*Primary Examiner*—Mark F Huff
*Assistant Examiner*—Peter L Vajda
(74) *Attorney, Agent, or Firm*—Lucas & Mercanti, LLP

(57) ABSTRACT

A toner including toner particles each containing a resin and a colorant, wherein the toner particle has:

a region A which contains the colorant and a region B through which more electrons can pass than the region A; and the region A is covered by the region B being within 1 μm deep from a circumference of the toner particle, when the toner particle is observed in a state of a microscopic segment having a thickness of 80 to 200 nm through a transmission electron microscope at an acceleration voltage of 80 kV.

16 Claims, 4 Drawing Sheets

TONER, MANUFACTURING METHOD THEREOF AND IMAGE FORMING METHOD

This application is based on Japanese Patent Application No. 2004-231969 filed on Aug. 9, 2004, in Japanese Patent Office, the entire content of which is hereby incorporated by reference.

TECHNICAL FIELD

This invention relates toner, a manufacturing method thereof and image forming method.

BACKGROUND

As the digitalization technology has made rapid progress, image forming technologies by an electrophotographic method for copiers, printers, and the like have come into wide use and the number of such devices in use has increased greatly.

Generally, the recent electrophotographic technology has made vigorous researches and developments aiming the four points below.

(1) Downsizing the image forming device (2) Speeding up the processing of the image forming device (3) Forming high-quality color images (4) Reducing the image forming power (for power saving)

To accomplish the purposes (1) to (3), you must rotate developing rollers of small diameters at a high speed. However, this method may contaminate images with scattered toner and deteriorate the developing rollers by toners fused thereto. These problems are hard to be solved.

A technology has been disclosed to solve such problems. This technology uses toner particles of equal electrostatic properties to increase the charging speed and the charge retaining ability of toner particles. (For example, see Patent Document 1)

As for power saving of (4), it is inevitable to reduce the flat power rate and power cost because, as a trend of the times, network environments have been arranged more conveniently, printers have been used more frequently in offices, and the digital equipment such as printers and facsimile equipment has been widely used in home.

Further, the electrophotographic image forming technology is expected to fan out into the print-on-demand (POD) and book-on-demand (BOD) fields in which the required number of copies can be made only on demand without preparing any plate.

However, the current image forming technology excels in processing speed but only the limited kinds of paper are available to the technology. For example, when processed by the technology, thin paper may have wrinkles on it and general coated glossy paper may have blisters (which cause image defects) due to steam on it. Further it has been difficult to give color reproducibility to form beautiful color images without being affected by collation accuracies (in book binding) and paper kinds.

To solve these problems, various tries have been made. One of the tries is to use chemical toners such as a representative polymeric toner which was described in above Patent Document 1. The try dynamically controls the structure of toner particles to design toner to solve the above problems. For example, a toner technology modifies the surfaces of toner particles by fusing resin particles to surfaces of another kind of resin particles which contains resins and colorants. This technology can suppress colorants from appearing on the surfaces of toner particles and form images which are stable in high humidity environments. Another toner technology controls dispersion and occupation of toner-containing components in toner production processes to make toner particles hard to be affected by environmental factors such as temperature and humidity. However, these technologies are not satisfactory yet. (For example, see Patent Document 2, Patent Document 3, and Patent Document 4.)

Particularly, this technology which improves toner performance by coating toner particle surfaces with resin has been proposed long before, but the resin particles may be coagulated during storage and transportation and cannot fully keep the stability in the charging speed and charge retention.

Patent Document 1: Japanese Non-Examined Patent Publication No. 2004-54240

Patent Document 2: Japanese Non-Examined Patent Publication No. 2002-116574

Patent Document 3: Japanese Non-Examined Patent Publication No. 2002-351142

Patent Document 4: Japanese Non-Examined Patent Publication No. H10-26842

In view of the foregoing, it is a main object of this invention to provide new toners for electrophotographic image forming apparatus such as small and fast copiers, printers, and facsimile equipment and more particularly to provide toners.

Still, another object of this invention is to provide toners which have greatly improved the charging speed and charge retaining ability, can form stable toner images even when the developing unit is downsized, can fix toner images to transferring materials at lower temperatures, and will not be coagulated together without being cooled or heat-insulated during storage or transportation.

Another object of this invention is to provide toners which have a sufficient fixing strength even at a low fixing temperature and can form even, excellent, uniform, and glossy images.

Further, this invention can provide toners which can form stable images on such kinds of paper (such as coated glossy paper and cardboard) that are hard to receive images by conventional technologies. In other words, still another object of this invention is to provide toners which enable selection of more kinds of paper for formation of toner images and fan-out of the on-demand image forming technology which can make the required number of copies without preparing any plate.

SUMMARY

An aspect of the invention is a toner comprising toner particles each containing a resin and a colorant, wherein the toner particle has: a region A which contains the colorant and a region B through which more electrons can pass than the region A; and the region A is covered by the region B being within 1 μm deep from a circumference of the toner particle.

Another aspect of the invention is the toner producing method including: preparing a region A which contains the colorant; and forming region B on the region A.

Another aspect of the invention is an image forming method, including the steps of: forming a latent image on an electrophotographic photoreceptor; developing the latent image with a toner mentioned above to form a visible toner image; transferring the toner image to a transferring material; heating the surface of the transferring material; and fixing the toner image on the transferring material.

DESCRIPTION OF THE PREFERRED EMBODIMENT

This invention can provide toners which have greatly improved the charging speed and charge retaining ability, can form stable toner images even when the developing unit is downsized, can fix toner images to transferring materials at lower temperatures, and will not be coagulated together without being cooled or heat-insulated during storage or transportation.

In other words, the toner prepared by this invention assures a high charging speed fit for fast image development by a small developer whose roller is 10 mm in diameter, ability to fix images at low fixing temperature, and anti-coagulation of toner in storage.

Further, the toner prepared by this invention can suppress filming (fusion) of toner to the surfaces of components (such as the surface of the photosensitive member, and the surface of the developing roller) which are in contact with the toner.

Furthermore, the toner of this invention enables selection of more kinds of paper available for toner image formation and printing of beautiful spot-less copies of uniform glossiness on coated paper, cardboard, and thin paper (without fixing wrinkles).

When observing the toner (80 to 200 nm in segment) of this invention through a transmission electron microscope at an acceleration voltage of 80 kV, a region through which electrons can pass-more easily around each toner particle can be observed.

Inventors have found that this structure (which provides a resin through which electrons can easily pass near the surface of each toner particle) improves the charging speed and charge retaining ability of the toner, ability to fix images at low fixing temperature, and anti-coagulation of toner in storage.

This invention forms the region through which electrons can easily pass near the surface of each toner particle by coagulating particles of the electron-transmittable resin to the surface of each resin particle which contains a colorants.

Below will be explained the details of toner particles of this invention.

[Structure of Toner Particles of This Invention]

First will be explained the structure of toner particles of this invention.

Figure 1:
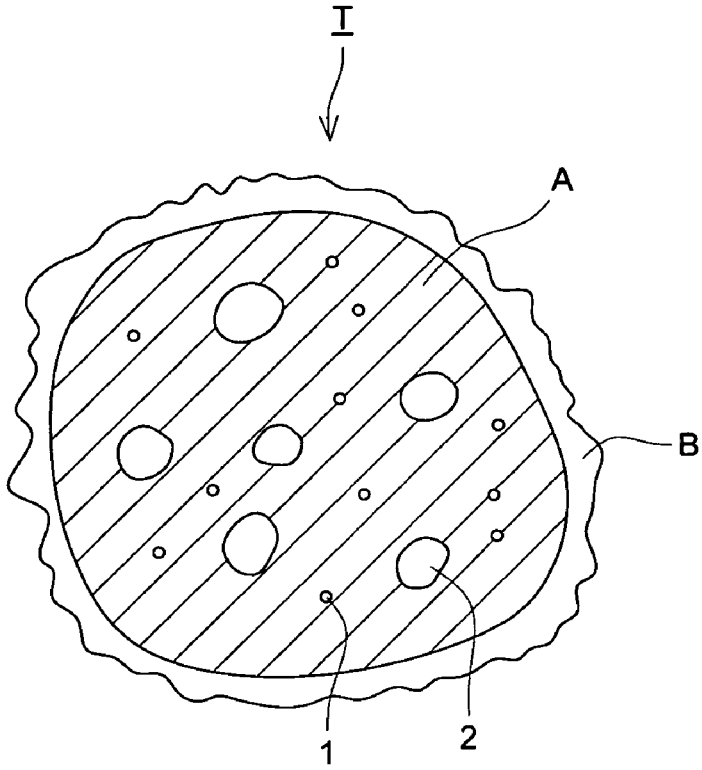
FIG. 1 shows a pattern diagram of the structure of toner particles of this invention.
Figure 1:
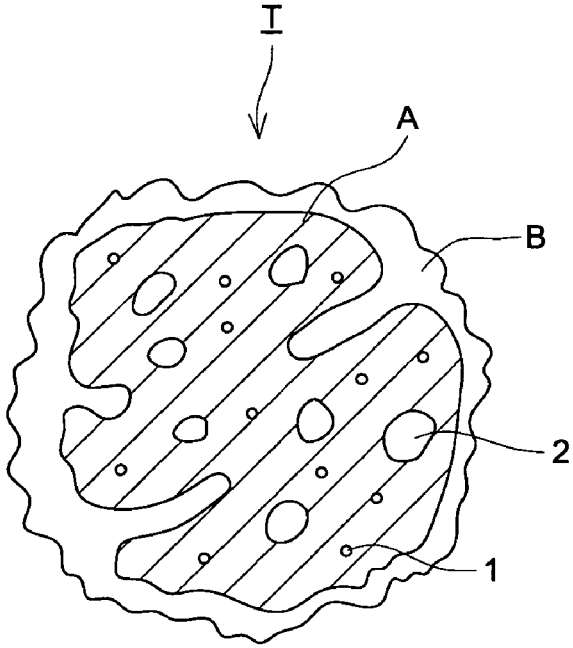

FIG. 1 shows a pattern diagram of the structure of toner particles of this invention.

FIG. 1 shows toner particle T, color-containing region A, region B which can pass electrons more easily than region A, colorants 1, and release agent 2.

In a process of manufacturing toner particles T of this invention, region B is formed around the surface of a resin particle of region A by attaching resin particles of a component different from that of region A to the surface of the resin particle of region A.

The toner particle of this invention has region B of up to 1 μm deep around the surface of the toner particles. As shown in FIG. 1 (*a*), region B should be up to 1 μm deep, preferably 0.08 to 1.00 μm, and more preferably 0.12 to 0.40 μm. As shown in FIG. 1 (*b*), this invention also has an effect on toner particles having part of region B which breaks into region A.

In this case, region B need not always cover the whole surface of the toner particle. It has been recognized that, as long as region B exists up to 1 μm deep around the toner particle, the toner of this invention can accomplish the objects of this invention. When the toner particle surface is covered by region B in an area of 40 to 100% of its surface or preferably 50 to 95% of the outer surface, the toner can have good low-temperature fixing ability and anti-coagulation of toner in storage.

It has been recognized that the toner of this invention has a steady charge-retaining performance. Although the reason for the steady charge-retaining performance has not been clear, It is possible that the toner particle of this invention can always hold electric charges of a constant level because electrons can move between regions A and B after the charge density reaches the constant level on the surface of the toner particle. In other words, since electrons coming into region A can go into region B, the charge of region B is recovered immediately when the charge density level goes down on the surface of the toner particle and consequently, the charge density level is held constant on the surface of the toner particle.

Contrarily, the conventional toner singly holds electric charges on the outermost surface of the toner particles and does not allow electrons to go into toner particles. Therefore, even when the electric charges go down on the surface of the toner particle, the toner particle has no charge to make up for it and as the result the charge-retaining performance of the toner goes down.

Although the toner of this invention can have both good low-temperature fixing ability and anti-coagulation of toner in storage, its mechanism is not known. It is possible that regions A and B are incompatible with each other and that, even when region A in a toner particle is made up of resin of low softening temperature and low glass-transition temperature, the resin of region B will not be influenced to reduce the glass-transition temperature and cause plasticization by the resin of region A. Judging from the above, it is possible that the toner of this invention can have both good low-temperature fixing ability and anti-coagulation of toner in storage.

[Means to Detect a Toner Structure]

It was experimentally found that toner particles (80 to 200 nm in segment) of this invention are emphasized in contrast to show the composition of resin of the toner when observed through a transmission electron microscope at an acceleration voltage of 80 kV. More specifically, it was able to be determined the quantities of resin components (monomer compositions) of the toner particles by observing toner particles (80 to 200 nm in segment) through a transmission electron microscope at an acceleration voltage of 80 kV.

By a conventional observation of toner particles through a transmission electron microscope at an acceleration voltage of about 200 kV, it could be observed how colorant and release materials are dispersed in toner particles, but could not be observed the resin composition of the toner particles. In this way, this invention finds conditions which enable observation of the resin composition through a transmission electron microscope.

As described above, the toner particle of this invention has region B which contains a resin capable of passing electron beams more easily on the surface of region A. This structure can be observed through a transmission electron microscope (TEM) when the toner segments are stained by a proper dye such as ruthenium tetraoxide.

The structure of toner particles is well-observed through a transmission electron microscope (TEM) which is well known to those skilled in the art such as H-9000NAR (by Hitachi, Ltd.) and JEM-200FX (Japan Electron Co., Ltd.). The sizes of regions A and B of toner particles of this invention be able to calculated from the result of TEM pictures (of 10 or more particles) which are taken at a power of 10,000. The observing magnification of the TEM can be varied freely as long as the sectional configuration of each toner can be recognized.

Toner particles can be observed through a transmission electron microscope (TEM) in a usual method of measuring toner particles. For example, the first step of the method is to prepare a toner sample for observation. Test sample were prepared by dispersing toner particles fully in room-temperature-setting epoxy resin, embedding toner particles in the epoxy resin, hardening the mixture into a block, dyeing the block together with ruthenium tetraoxide or tri-osmium tetraoxide if necessary, and slicing the block into a segment of 80 to 200 nm thick by a microtome with diamond teeth.

Then, photos of toner particle sections were taken through a transmission electron microscope (TEM). The resin composition of the toner particles on the photos was visually examined. If necessary, it is also possible to arithmetically process image information by image processor LUZEX F (by NIRECO Corp.) to measure the thickness of layers in the toner particle.

[Means to Produce Toners of this Invention]

Below will be described a means to produce toners of this invention.

The conditions below would be preferable to be satisfied to accomplish the toner of this invention that shows a region capable of passing electrons more easily around each toner particle when observed through a transmission electron microscope (TEM) at an acceleration voltage of 80 kV.

(a) The solubility parameter (SP) value of resin in region B is lower than that of resin in region A and the difference between the solubility parameter values is 0.2 to 0.8.

(b) The resin of region B contains vinyl polymer having an alkyl or alkylene group of 6 to 20 carbons which can branch.

(c) A resin in Region B has glass-transition temperature (Tg) being 50 to 65° C. and region A has a mixture of a fixing assistant and a resin whose glass-transition temperature is −20 to 39° C.

These will be explained in detail below.

[Solubility Parameter Value]

In this invention, the resin forming region B in the toner particle is not compatible with the resin in region A and the resin in region B is fully adhesive to the resin in region A.

The non-compatibility between resin in region B and resin in region A can be expressed by a difference between the solubility parameter value (hereinafter called SP value) of resin in region B and that of resin in region A. The value should be in an appropriate range.

The SP value means the magnitude of cohesive energy of a substance and is expressed by Equation (1) proposed by Feors (see Polym. Eng. Sci., Vol 14, p. 147 (1974).)

$$\sigma=(\Sigma\Delta e_i/\Sigma\Delta v_i)^{1/2} \quad \text{Equation (1)}$$

where

σ: Solubility parameter value of binding resin $\Delta e_i$: Energy of vaporization of atom or atomic group $\Delta v_i$: Molar volume of atom or atomic group The solubility parameter value of each vinyl copolymer is calculated from the product of the solubility parameter value of each component and the molar ratio of the component. For example, let's assume a copolymer resin is made of two kinds of monomers (X and Y) (wherein their mass composition ratios are x and y (% by weight) their molecular weights are Mx and My, and their solubility parameter values are SPx and SPy). The molar ratios of monomers are expressed by x/Mx (mole percentage) and y/My (mole percentage). The molar ratio of the copolymer resin is expressed by C=x/Mx+y/My. The solubility parameter value (SP) of this copolymer resin is expressed by Equation (2).

$$Sp=\{(x\times SPx/Mx)+(y\times SPy/My)\}\times 1/C \quad \text{Equation (2)}$$

where SPx and Spy are solubility parameter values of monomers obtained by Equation (1). For substantial solubility parameter values, see Polymer Handbook (published by Wiley Japan) Version 4 or the like.

The solubility parameter values can be controlled by changing the composition ratio of monomers in the vinyl copolymer. For example, solubility parameter values of a copolymer resin which contains styrene and methyl methacrylate can be controlled by decreasing the composition ratio of styrene and increasing the composition ratio of methyl methacrylate. It can be found that this has a tendency to reduce the solubility parameter value.

For more information of solubility parameters of polymer materials, see "Solubility Parameters" (http://polymer.nims-.go.jp/guide/guide/p5110.html) of PolyInfo database, National Institute for Materials Science (http://polymer.n-ims.go.jp) (Independent Administrative Institution).

The solubility parameter value of resin in region B is lower than that of resin in region A and the difference between the solubility parameter values is 0.2 to 0.8 (at which a stable non-compatibility is obtained) and more preferably 0.3 to 0.7.

As for the toner of this invention, the SP value of the copolymer resin which forms region B should preferably be 9.5 to 10.0 and more preferably 9.59 to 9.84. Similarly, the SP value of the copolymer resin which forms region A should preferably be 10.0 to 10.5. The SP value of the copolymer resin can be controlled by selecting appropriate kinds of polymeric monomers.

As described above, the toner of this invention makes regions A and B noncompatible when there is a certain difference between their solubility parameter values (SP values).

Further, the toner of this invention shows a preferable adhesiveness of component resins in regions A and B when the difference between their solubility parameter values (SP values) is 0.2 to 0.8. A preferable adhesiveness to the surface of region A can be secured, for example, by selecting polymeric monomers for resins constituting regions A and B from a group of compounds listed below and determining an SP value difference in the above range. It is to be expressly understood, however, that the compounds listed below are to illustrate the means to accomplish the objects of this invention and is not intended as a definition of the limits of this invention.

[Resins to Form Region B]

To cause resin in region B in the outermost part of a toner particle to pass electrons more easily, resin in region B should preferably be made of a vinyl polymer having an alkyl or alkylene group of 6 to 20 carbons which can branch. This resin is prepared by polymerizing a monomer having an alkyl or alkylene group of 6 to 20 carbons which can branch.

Below are listed representative polymeric monomers having an alkyl or alkylene group of 6 to 20 carbons which can branch. Hexyl (meth)acrylate, 2-ethyl hexyl acrylate, diacrylic ester of hexa-methylene glycol, and diacrylic ester of behenyl glycol. Among these, 2-ethyl hexyl acrylate is preferable.

Forming region B using fluorinated or silylated acrylate was also tried, but it was impossible to prepare the toner particles of this invention because it requires a lot of monomer of a high SP value to control the SP value difference between regions A and B.

The copolymer ratio of the polymeric monomer in the copolymer resin which forms region B should be 8 to 40% by weight and preferably 9 to 20% by weight.

It is preferable that the monomer for a resin which forms region B is prepared by copolymerization of a polymeric monomer such as methyl methacrylate, styrene, and methacrylic acid which may increase the glass-transition temperature (Tg) of the resin.

In addition to the above, these polymeric monomers can be of acid anhydride or metallic vinyl carboxylate.

Furthermore, the copolymer resin forming region B of this invention can be prepared from styrene monomer.

Below is listed a representative polymeric monomer for copolymer resin which forms region B. Copolymer resin of styrene (5 to 25 mass parts), methyl methacrylate (30 to 60 mass parts), methacrylic acid (0.5 to 5 mass parts), acrylic acid-2-ethylhexyl (20 to 40 mass parts)

[Glass-Transition Temperature]

To prepare the toner of this invention, the glass-transition temperature of resin in region B should preferably be 50 to 65° C. and the glass-transition temperature of resin in region A should preferably be −20 to 39° C.

The glass-transition temperature is usually measured by a differential scanning calorimeter (DSC). A typical DSC is Perkin-Elmer DSC-7.

A substantial method of measuring a glass-transition temperature of a test sample contains the steps of keeping the test sample at −30° C. for one minute and heating the sample to 100° C. at a rate of 10° C./minute (the first heating step to erase the previous record), keeping the test sample at 100 C. for one minute and cooling the sample down to 0° C. at a rate of 10° C./minute (the first cooling step), keeping the test sample at 0° C. for one minute and heating the sample to 100° C. at a rate of 10° C./minute (the second heating step), and getting the endothermic peak temperature in the second heating as the glass-transition temperature (Tg) of the test sample.

The glass-transition temperature (Tg) is defined as an intersection at which the extension of the base line below the glass-transition temperature (Tg) on the DSC thermogram in the glass transition area meets a tangent of the greatest gradient between the rise and the top of the peak.

In this invention, the glass-transition temperature (Tg) of resin which forms region B should be 50 to 65° C. and preferably be 40 to 80° C. higher than the glass-transition temperature of resin in region A. The glass-transition temperature of resin in region A can be any as long as it is lower than the glass-transition temperature of resin in region B.

The glass-transition temperature of the copolymer resin can be controlled by the kinds and mass percentages of polymeric monomers which constitute the copolymer.

In addition to the above factors, the toner of this invention should preferably determine the molecular weights and softening points of resins in regions A and B as shown below.

[Molecular Weight]

It is preferable to set the molecular weights of resins which form regions A and B in the toner particle of the invention respectively to specific ranges. Specifically, it is preferable to use resin of the molecular weight of 15,000 to 25,000 for resin in region A and resin of the molecular weight of 10,000 to 35,000 for resin in region B.

Resins which form regions A and B are usually made up of some kinds of vinyl copolymer resins. However, the resin forming region B should preferably have a peak molecular weight in the above range to keep the strength of the toner particles.

It is possible to measure the above peak molecular weight by the gel-permeation chromatography (GPC) which uses tetrahydrofuran (THF) as the column solvent.

The specific method using the GPC method has the steps of adding 1 ml of THF to 1 mg of a test sample, stirring the mixture by a magnetic stirrer at the room temperature until the test sample dissolves completely, filtrating the solution by a membrane filter of the pore-size of 0.45 to 0.50 μm, putting the filtrate in the GPC, and measuring the peak molecular weight of the test sample while stabilizing the column at 40° C., feeding THF at 1 ml per minute and adding a test sample of about 100 μl (of a concentration of 1 mg/ml). Preferable columns are a combination of polystyrene gel columns that are commercially available, for example, a combination of Shodex GPC KF-801, 802, 803, 804, 805, 806, and 807 (by Showa Denko K. K.) or a combination of TSK Gel G1000H, G2000H, G3000H, G4000H, G5000H, G6000H, G7000H, and TSK guard column (by Tosoh).

A refractive index detector (IR detector) or UV detector) is preferably used as a detector. For measurement of molecular weights of test samples, the distribution of molecular weights of the test sample is calculated from analytical curves which are created using standard monodispersed polystyrene particles. About 10 polystyrene pieces should preferably be used to create analytical curves.

[Softening Temperatures]

The softening point (Tsp) of the toner of this invention should preferably be 75 to 98° C. It can be fixed to transfer sheets even when the sheet surfaces are 100° C. or lower, when the mass percentage of resin in region B is 5 to 30% of the whole toner particle. By arranging the amount of resin in B region, it can improve the storage stability of the toner without giving any influence to the softening point. Therefore, the toner of this invention can be fixed at temperatures which will not cause steam generation (to damage images) and curling of transfer sheets.

There are many ways to control the softening points of toner particles: for example, to control kinds of monomers which constitute the resin (to be formed into particles) and the component ratios of monomers in copolymer, to control the quantity of a chain transfer agent and thus control the degree of polymerization, and to control the kinds and quantities of release agents and fixing assistants to be added to the toner. A toner having a target softening point can be obtained by combining these ways. Further, the softening point of a specific resin can be also controlled by plotting the relationship of molecular weights and softening points of the resin.

One method of measuring the softening point of the toner comprises, for example, the steps of using flow tester CFT-500 (by Shimazu Corp.), sieving the test sample into 9.2-mesh-pass grains (opening of 2.0 mm) and 32-mesh-on grains (opening of 0.5 mm), forming the sieved toner particles into a cylinder of 10 mm high, putting the cylinder-shaped test sample in the flow tester, giving a load of 20 kg/cm$^2$ by the plunger while heating it at a rate of 6° C./minute to extrude the nozzle of 1 mm long and 1 mm in diameter, plotting the relationship of the fall of the flow tester plunger and the temperature (a softening flow curve), and getting the temperature as the softening point when the nozzle falls 5 mm.

[Resins Used for Region A]

Below will be explained a resin (polymer) which is preferably used for region A.

A preferable polymeric monomer for a resin which constitutes region A is a styrene monomer or a mixture of a styrene monomer and a copolymeric monomer. In this case, the styrene monomer should preferably be 50% by weight or more of the whole monomer.

Representative styrene monomers are styrene and p-methyl styrene. Representative copolymeric monomers to be used together with the styrene monomer are acrylic ester monomers such as ethyl acrylate, butyl acrylate, and 2-ethyl hexyl acrylate;

methacrylic ester monomers such as methyl methacrylate, ethyl methacrylate, and butyl, methacrylate;

vinyl ester monomers such as vinyl acetate, vinyl butyrate, and alkyl vinyl ether such as methyl vinyl ether;

N-alkyl substituted acrylamide such as N-methyl acrylamide and N-ethyl acrylamide;

nitrile monomers such as acrylonitrile and methacrylonitrile;

and multifunctional monomers-such as di-vinyl benzene, ethylene glycol (meth)acrylate, and trimethylol propane tri-(meth)acrylate.

Representative bridging monomers are, for example, di-vinyl benzene, di-vinyl naphthalene, di-vinyl ether, di-ethylene glycol methacrylate, ethylene glycol di-methacrylate, polyethylene glycol di-methacrylate, and diallyl phthalate. These monomers respectively have 2 or more unsaturated bonds.

The bridging monomers, when used, make it harder to allow the polymer chain structure of a binding resin to have regularity and synchronism. In other words, they can make the resin amorphous and increase the strength of the resin without increasing the binding energy of polymer chains. As the result, this increases the durability of the toner. For example, this can make the toner be fixed at lower temperature and endure repetitive stirring in the developer.

Specifically, for example, a copolymer resin of styrene, butyl acrylate, and methacrylic acid is used as a copolymeric resin which constitutes region A. The monomers in the composition are preferably 70 to 85 mass parts of styrene, 15 to 30 mass parts of butyl acrylate, and 0.5 to 5 mass parts of methacrylic acid.

The solubility parameter value (SP value) of a resin which forms region A should preferably be 10.0 to 10.5. It is preferable that the region A contains a fixing assistant and its glass-transition temperature is −20 to 39° C.

Below will be explained a method of producing the toner particles of this invention.

A preferable method of producing the toner particles of this invention is an emulsifying polymerization method which easily gives an adequate unevenness to the layer thickness of region B which coats region A. The uneven layer thickness of region B is preferable because it enables fixing at low temperature and assures anti-coagulation of toner in storage.

Below will be explained processes to produce resin particles (a) which form region A, region-A particles, dispersion liquid of region-A particles, resin particles (b) which form region B, dispersion liquid of region B particles, and toner particles.

(Resin Particles (a) which Form Region A)

Resin particles (a) which form region A are prepared by selecting kinds and compounding ratios of polymeric monomers to get the SP value of 10.0 to 10.5 and the glass-transition temperature (Tg) of −20 to 39° C. and copolymerizing thereof to get a resin of molecular weight of 15,000 to 25,000. The preferable number average primary particle size of the resin particles is 10 to 1,000 nm.

The SP value and Tg of region A are equal to those of resin particles (a) which forms region A.

The region-A particles are prepared at least by polymerizing a polymeric monomer in a water solvent. This preparing method comprises the steps of polymerizing a polymeric monomer by a suspension polymerization into resin particles (a), or emulsifying and polymerizing a monomer in a liquid (water-based solvent) which contains emulsifying liquid as a required additive, or preparing fine resin particles (a) by a mini-emulsion polymerization, adding charge-controlling resin particles if necessary, and adding a coagulant such as organic solvent or salts, and thus coagulating and bonding the particles together.

(Suspension Polymerization)

An example of method for producing region-A particles comprises the steps of dissolving a charge-controlling resin in a polymeric monomer, adding a colorant, fixing assistant, release agent, polymerization initiator, and other component if necessary to the mixture, dissolving or dispersing the components in the polymeric monomer mixture by a homogenizer, sand mill, sand grinder, or ultrasonic disperser, adding this polymeric monomer in which components are dissolved or dispersed to the water-based solvent which contains a dispersion stabilizer, dispersing the polymeric monomer in the water-based solvent by a homogenizing mixer or homogenizer until the region-A particles are formed into oil droplets of desired sizes, transferring this homogenized mixture to a reactor (stirring device) equipped with a stirring mechanism of particular stirring blades, and polymerizing the mixture into region-A particles in the reactor while heating and stirring thereof.

(Emulsifying Polymerization)

The region-A particles can be prepared also by salting out or bonding resin particles (a) in a water-based solvent. This method is disclosed, for example, by Japanese Non-Examined Patent Publications H05-265252, H06-329947, and H09-15904 but this invention is not limited to this method. Specifically, the method salts out, coagulates, and bonds resin particles, colorant, and if necessary, dispersed component particles such as fixing assistant and release agent, or some kinds of particles made up of resin and colorant. The method comprises the steps of dispersing the particles in water by an emulsifying agent, salting out thereof by a coagulant of a critical concentration of coagulation or higher, heating the salted-out particles at a the glass-transition temperature of the particles or higher to bond the particles together into bigger particles, adding a lot of water to the liquid to stop growth of the particles when the particles have a target grain size, heating and stirring thereof to smooth particle surfaces and control particle shapes, and producing region-A particles. In this case, the coagulant can be added together with a solvent such as alcohol that can dissolve into water unlimitedly.

In the above method of producing region-A particles, the resin particles (a) and the colorant particles are salted out and bonded at least after the polymeric monomers are dissolved and polymerized.

The above method of producing region-A particles uses a multistage polymerization to salt out and bond the resin particles (a) and the colorant. The multistage polymerization will be explained in detail below.

<<Method of Producing Resin Particles (a) by a Multistage Polymerization>>

The method of producing resin particles (a) comprises the steps below.

1: Multistage polymerization process

2: Process of salting out and bonding the resin particles (a) and the colorant to get region-A particles These processes will be explained in detail below.

[Multistage Polymerization Process]

This polymerization process polymerizes a resin monomer and enlarges the molecular weight distribution of respective resin particles to prepare region-A particles without offsets. In other words, this process carries out polymerization in steps to create phases of different molecular weight distributions on each resin particle. Specifically, the main purpose of this process is to vary molecular weights of each resin particle from the center of the particle to the outer surface of the particle. For example, a surface layer of a low molecular weight is formed by first preparing a resin particle dispersing liquid containing a resin of high molecular weight and adding an additional polymeric monomer and a chain transfer agent to the liquid.

With the objects of stability in production and crushing strength of the obtained region-A particles, this invention should preferably employ a multistage polymerization method of 3 or more polymerization stages. Below will be explained the representative 2- and 3-stage polymerization methods. The region-A particles prepared by such a multistage polymerization should preferably be lower in molecular weight as it comes nearer to the surface.

(2-Stage Polymerization)

This polymerization method produces resin particles (a) each of which consists of a core of a high molecular-weight resin and an outer surface (shell) of a low molecular-weight resin.

Specifically, the 2-stage polymerization can be shown by steps of first obtaining a liquid which disperses resin particles of high molecular weight by preparing a monomer solution, dispersing the monomer solution in a water-based solvent (such as an aqueous solution of a surfactant) in an oil-droplet form, and polymerizing the mixture (as the first polymerization).

Next, a polymerization initiator and a monomer (to get a resin of low molecular weight) are added to this dispersion liquid and polymerizing the monomer in the presence of resin particles (as the second polymerization). With this, each resin particle is coated with a resin of lower molecular weight.

(3-Stage Polymerization)

This polymerization method produces resin particles (a) each of which consists of a core of a high molecular-weight resin, an intermediate layer, and an outer surface (shell) of a low molecular-weight resin. The region-A particles exist in the form of the resin particles (a).

Specifically, polymerization described above can be shown by the steps of first obtaining a liquid which disperses resin particles by an ordinary polymerization (as the first polymerization, putting this dispersion liquid in a water-based solvent (such as an aqueous solution of a surfactant), dispersing a monomer solution in the water-based solvent in an oil-droplet form, polymerizing the mixture (as the first polymerization), forming an intermediate layer of resin (polymer made from the monomer) on the outer surface of each core (resin particle), and preparing a dispersion liquid of compound resin particles (high molecular-weight resin and intermediate molecular-weight resin).

Then a polymerization initiator and a monomer (to get a resin of low molecular weight) are added to this dispersion liquid of compound resin particles and polymerizing the monomer in the presence of compound resin particles (as the third polymerization). With this, each compound resin particle is coated with a resin of a lower molecular weight (polymer made from the monomer).

One of the features of the above region-A-particle producing method is to polymerize polymeric monomers in a water-based solvent. In other words, this method forms the intermediate (coating) layer as a latex layer by dispersing a monomer solution in the water-based solvent in an oil-droplet form, adding a polymerization initiator to this mixture, and polymerizing thereof.

The water-based solvent of this invention is a mixture of 50 to 100 mass percentages of water and 50 to 0 mass percentages of a water-soluble organic solvent such as methanol, ethanol, isopropanol, butanol, acetone, and tetrahydrofuran. Alcohol-related organic solvents are preferable because they will not dissolve the obtained resin.

A preferable polymerization method of forming resin particles or coating layers comprises the steps of putting a monomer solution in a water-based solvent which contains a surfactant of a critical micelle concentration or lower, dispersing the monomer solution in the solvent in an oil droplet form by mechanical energy, adding a water-soluble polymerization initiator to the resulting dispersion liquid, and polymerizing the monomer radically in the oil droplets. (This method is called "mini-emulsion method" in this invention). The above method can use an oil-soluble polymerization initiator instead of or together with the water-soluble polymerization initiator.

Any dispersing machine can be used to disperse the monomer solution in the solvent in an oil droplet form by mechanical energy. For example, representative dispersing machines are CLEARMIX (by M Technique) which is a stirring device with a high-speed rotor, ultrasonic dispersing machine, mechanical homogenizer, Manton Gorlin, and pressure type homogenizer. The sizes of dispersed particles are 10 to 1000 nm, preferably 50 to 1000 nm, and more preferably 30 to 300 nm.

Another polymerization method of forming resin particles or coating layers can be an emulsifying polymerization method, suspension polymerization method, seeded polymerization method, and other well-known polymerization method.

The grain size of resin particles (a) prepared by this polymerization process should preferably be 10 to 1000 nm (weight average grain size measured by Electrophoretic Light Scattering Photometer ELS-800 (by Otsuka Electronics Co., Ltd.)).

The glass-transition temperature (Tg) of the resin particles (a) should be −20 to 39° C. and preferably 20 to 37° C.

The region-A particles can be prepared by forming a layer of resin particles on the resin and colorant particles by salting out or bonding. This will be described in detail below.

[Salting/Bonding Process]

This process prepares region-A particles by salting out and bonding resin particles (a) which are obtained by the above multistage polymerization process and the colorant particles (at the same-time).

"Salting/bonding" of this invention means a phenomenon that both salting (to coagulate particles) and bonding (to eliminate particle-to-particle interfaces) take place at the same time or an action to make both salting and bonding take place at the same time. To carry out both salting and bonding at the same timer particles (resin particles and colorant particles) must be coagulated at the glass-transition temperature (Tg) or higher of the resin in the resin particles (a).

In the salting/bonding process, it is possible to salt out and bond particles of additional additives such as charge controlling material (whose number average primary particle size is 10 to 1000 nm) together with the resin particles (a) and the colorant particles. The surface of the colorant particles can be modified by a well-known adulterant.

<<Preparation of a Colorant-Particle Dispersing Solution>>

It is possible to disperse a colorant in a water-based solvent by putting the colorant in a water-based solvent which contains a surfactant and give a shearing force to the mixture. This method is disclosed for example by Japanese Non-Examined Patent Publication No. 2000-292973.

In other words, the colorant is dispersed in the water-based solvent which contains a surfactant by the action of the shearing force caused by a screen which partitions the stirring chamber and a rotor which rotates fast in the chamber (and by the actions of collision force, pressure fluctuation, cavitations, and potential core). With this, a colorant-particle dispersing liquid is prepared.

The weight average grain size (dispersed diameter) of colorant particles is 30 to 500 nm and preferably 50 to 300 nm. If the grain size is less than 30 nm, the colorant particles float vigorously and it will be hard for the colorant particles to be taken into region-A particles. Contrarily, if this grain size is greater than 500 nm, the colorant particles will not be fully dispersed in the water-based solvent and will quickly settle down and it will be hard for the colorant particles to be taken into region-A particles. In this case, the colorant particles may be free and isolated. The weight average grain size of the colorant particles is measured by Electrophoretic Light Scattering Photometer ELS-800 (by Otsuka Electronics Co., Ltd.).

In the distribution curve of colorant grain sizes, the standard deviation should preferably be 30 or less and more preferably 20 or less. When the standard deviation is 30 or less, the distribution curve of colorant grain sizes becomes sharp and the colorant particles can be taken into the region-A particles positively. As the result, the colorant particles are hard to be freed and isolated. The "distribution curve of colorant grain sizes" is plotted by Electrophoretic Light Scattering Photometer ELS-800 (by Otsuka Electronics Co., Ltd.) and the standard deviation is calculated by ELS-800.

The colorant particles for the region-A particles are prepared by the steps of putting the colorant in a water-based solvent which contains a surfactant, preliminarily stirring the mixture (roughly) by a propeller stirrer or the like to make a preliminary dispersion liquid (which disperses coagulated colorant particles), transferring the preliminary dispersion liquid in a stirring machine which is equipped with a screen which partitions the stirring chamber and a rotor which rotates fast in the chamber, and stirring the liquid by this stirring machine (to make a fine dispersion liquid).

A representative dispersing machine fit for preparing a colorant dispersing liquid is CLEARMIX (by M Technique). CLEARMIX is designed to generate the actions of shearing force, collision force, pressure fluctuation, cavitations, and potential core by the rotor (stirring blades which rotate the liquid at a high speed and a stationary screen (ring) around the rotor. CLEARMIX emulsifies the liquid to disperse particles in the liquid by their multiplier effects. In other words, although CLEARMIX is designed to emulsify a liquid mixture (to disperse liquid particles), inventors use CLEARMIX to disperse solid colorant particles in a water-based solvent. With this, a colorant dispersing liquid having optimum mean grain sizes and a sharp grain size distribution curve can be obtained.

(Region-A Particles)

The region-A particles contain resin particles (a) which form region A, a colorant, and other materials such as a fixing assistant and a release agent if necessary.

(Preparation of Region-A-Particle Dispersing Liquid)

Any method can be used to prepare a dispersing liquid of region-A particles as long as the region-A particles satisfy the above conditions, but an emulsifying association method is preferable judging from that resin particles (b) which form region B are bonded to the surfaces of the region-A particles.

Specifically, the method prepares the region-A-particle dispersing liquid by mixing resin particles (a) which forms region A, a colorant, and other materials such as a fixing assistant and a release agent if necessary, coagulating the particles in the mixture, adding salt to the mixture to stop coagulation when the particles have preset sizes (2.5 to 9.0 μm), and letting the particles attach to each other.

The grain size (D50) of the region-A particles should be 2.5 to 9.0 μm and preferably 3.5 to 7.0 μm. An electric-resistance type grain-size-distribution tester such as Coulter Multisizer (by Beckman Coulter) and SD-2000 (by Sysmex Corp.) is used to measure the grain sizes.

The grain (particle) size (D50) of the invention is a median diameter of grain size distribution based on volume.

A method for measuring and calculating the grain size (D50) is conducted by using an apparatus that a computer system for data processing (by Beckman Coulter) is connected with Coulter Multisizer III.

The steps for measuring are (1) preparing particle dispersion, (2) putting the particle dispersion into a beaker including ISOTON II (by Beckman Coulter) until a measured density is 5% to 10% by pipette, and (3) measuring on the condition that setting count numbers of the apparatus are 2500. The particle dispersion is prepared by ultrasonic dispersing the mixture of particle of 0.02 g and surfactant-dispersion of 20 ml. For example the surfactant-dispersion which can be used is prepared by diluting neutral detergent including surfactant component with water. The diameter of aperture is 100 μm.

The concentration of the region-A particles in the region-A-particle dispersing liquid should preferably be 4 to 35 mass percentages and more preferably 7 to 20 mass percentages. In this range of concentration, the formation of region B is promoted.

Next will be explained particle components such as fixing assistant, release agent, colorant, and surfactant which are used for production of the region-A particles of this invention. Polymeric monomers will not be explained here because they are already explained above.

Fixing Assistant

Region-A of the toner of this invention should preferably contain a fixing assistant to control the softening point of the resin. Specifically, a representative fixing assistant is vinyl polymer or α-olefin polymer such as poly-1-butene whose number average molecular weight is 1500 to 3500.

The concentration of the fixing assistant in the toner particles of this invention should preferably be 1 to 30 mass percentages (of the whole weight of the toner particles), more preferably 7 to 27 mass percentages, and most preferably 10 to 25 mass percentages.

A preferable one of the fixing assistants is poly-1-butene (whose number average molecular weight is 2000).

Release Agent

Any well-known release agent is available to the toner of this invention. A preferable release agent is expressed by the general formula below.

General Formula $$R_1—(OCO—R_2)n$$

where n: integer of 1 to 4 (preferably 1 to 4 and more preferably 1 to 2)

$R_1$, $R_2$: Hydrocarbon group which can have a substituent $R_1$: Hydrocarbon group of 1 to 40 carbons, preferably 1 to 30 carbons, and more preferably 16 to 26 carbons $R_2$: Hydrocarbon group of 1 to 40 carbons, preferably 14 to 30 carbons, and more preferably 16 to 26 carbons Among ester compounds having the above formula, behenyl behenate, stearyl stearate, behenyl stearate, stearyl behenate, and the like are preferable. Additionally, paraffin wax denatured by a polar group, higher alcohol, and the like are preferably used. The concentration of the release agent in the toner particles should preferably be 1 to 30 mass percentages, more preferably 7 to 27 mass percentages, and most preferably 10 to 25 mass percentages.

Colorant

Any well known organic pigment and dye are available as colorants for the toner of this invention. Representative organic pigment and dyes are listed below.

Magenta or Red Pigments

C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166. C.I. pigment red 177, C.I. pigment red 178, and C.I. pigment red 222.

Orange or Yellow Pigments

C.I. pigment orange 31, C.I. pigment orange 43, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, C.I. pigment yellow 138, C.I. pigment yellow 180, C.I. pigment yellow 185, C.I. pigment yellow 155, and C.I. pigment yellow 156.

Green or Cyan Pigments

C.I. pigment blue 15, C.I. pigment blue 15:2, C.I. pigment blue 15:3, C.I. pigment blue 16, C.I. pigment blue 60, and C.I. pigment green 7.

Dyes

C.I. solvent red 1, C.I. solvent red 49, C.I. solvent red 52, C.I. solvent red 58, C.I. solvent red 63, C.I. solvent red 111, C.I. solvent red 122, C.I. solvent yellow 19, C.I. solvent yellow 44, C.I. solvent yellow 77, C.I. solvent yellow 79, C.I. solvent yellow 81, C.I. solvent yellow 82, C.I. solvent yellow 93, C.I. solvent yellow 98, C.I. solvent yellow 103, C.I. solvent yellow 104, C.I. solvent yellow 112, C.I. solvent yellow 162, C.I. solvent blue 25, C.I. solvent blue 36, C.I. solvent blue 60, C.I. solvent blue 70, C.I. solvent blue 93, C.I. solvent blue 95, and mixtures of the above.

Black Pigments

Carbon black such as furnace black, channel black, acetylene black, thermal black, and lamp black, and magnet powder such as magnetite and ferrite.

These organic pigments and dyes can be used singly or in combination by request. The quantity of pigments to be added should be 2 to 20 mass percentages (to the whole weight of the polymer) and preferably 3 to 15 mass percentages.

Surfactant

In the process of producing toner particles of this invention, it is preferable to use a surfactant to disperse oils in a water-based solvent. Any surfactant is available to this invention. Below are listed preferable ionic surfactants.

Ionic Surfactants

Sulfonates (sodium dodecylbenzene sulfonate, arylalkyl polyether sodium sulfonate, 3,3-disulfone-diphenyluera-4,4-diazo-bis-amino-8-naphtol-6 sodium sulfonate, ortho-carboxybenzene-azo-dimethyl aniline, 2,2,5,5-tetramethyl-triphenylmethane-4,4-diazo-bis-p-naphtol-6 sodium sulfonate, etc.), Sulfate ester (dodecyl sodium sulfate, tetradecyl sodium sulfate, pentadecyl sodium sulfate, octyl sodium sulfate, etc.), Fatty acid salts (sodium oleate, sodium laurate, sodium caprate, sodium caprylate, sodium caproate, potassium stearate, calcium oleate, etc.).

It is preferable to use the surfactants of general formulae (1) and (2) below together.

$$R_1(OR_2)_nOSO_3M \qquad \text{General formula (1)}$$

$$R_1(OR_2)_nSO_3M \qquad \text{General formula (2)}$$

where $R_1$: Alkyl or allyl alkyl group of 6 to 22 carbons, preferably 8 to 20 carbons, and more preferably 9 to 16.

$R_2$: Alkylene group of 2 to 6 carbons and preferably 2 to 3 carbons.

Representative alkylene groups of 2 to 6 carbons are ethylene, trimethylene, tetramethylene, propylene, and ethylethylene groups.

n: Integer of 1 to 11, preferably 2 to 10, more preferably 2 to 5, and most preferably 2 to 3.

M: Monovalent metallic element such as sodium and lithium

Sodium is preferably used.

Below will be listed actual examples of surfactants of general formulae (1) and (2). However, the surfactants of this invention are not limited to these examples.

Compound (101): $C_{10}H_{21}(OCH_2CH_2)_2OSO_3Na$

Compound (102): $C_{10}H_{21}(OCH_2CH_2)_3OSO_3Na$

Compound (103): $C_{10}H_{21}(OCH_2CH_2)_2SO_3Na$

Compound (104): $C_{10}H_{21}(OCH_2CH_2)_3SO_3Na$

Compound (105): $C_8H_{17}(OCH_2CH(CH_3))_2SO_3Na$

Compound (106): $C_{18}H_{37}(OCH_2CH_2)_2OSO_3Na$

As already explained, the toner production process of this invention contains a step of coagulating resin particles in the resin-particle dispersing liquid which is prepared by dispersing resin particles in a water-based solvent. A metallic salt is preferably used to coagulate resin particles. Specifically, di- or tri-valent metallic salts are preferably used as the coagulant. Di- or tri-valent metallic salts are more preferable than mono-valent metallic salts because their critical coagulation concentration (flocculation value or point) is lower.

The critical coagulation concentration in this invention is an index of stability of materials dispersed in a water-based dispersion liquid and means the concentration of a coagulant added to cause coagulation. The critical coagulation concentration is greatly dependent upon the kinds of latex and dispersant. This is disclosed for example, by "Polymer Chemistry 17, 601" by Seizou OKAMURA, et al. (1960). The critical coagulation concentration values therefrom can be obtained.

It is also possible to get the critical coagulation concentration of a salt by putting the salt in a target dispersion liquid, measuring the ζ potential of the dispersion liquid while varying the concentration of the salt, and getting the salt concentration at which the ζ potential starts to change.

(Resin Particles (b) which Form Region B)

The resin particles (b) which form region B are prepared by selecting a kind and a compounding ratio of polymeric monomer to get the SP value of 9.5 to 10.0 and the Tg value of 50 to 65° C. and co-polymerizing the monomer to have a molecular weight of 10,000 to 35,000.

The SP value and Tg of region B are equal to those of resin particles (b) which form region B.

The volumetric primary grain size (D50) of the resin particles (b) which form region B should preferably 50 to 240 nm.

(Preparation of a Dispersion Liquid of Resin Particles (b) which Form Region B)

A preferable region-B-particle dispersing liquid is a water-based dispersion liquid which forms micelle particles from resin particles (b) obtained by polymerization of a polymeric monomer and dispersed thereof. Any method can be used to produce a dispersion liquid of resin particles which form region B as long as the micelle formation of the resin particles (b) is enabled. Preferable methods are emulsifying polymerization, mini-emulsion polymerization, and seeded polymerization methods.

The concentration of the resin particles (b) in the region-B-particle dispersing liquid should preferably be 5 to 50 mass percentages and more preferably 20 to 40 mass percentages.

(A Method of Adding the Region-B-Particle Dispersing Liquid to the Region-A-Particle Dispersing Liquid)

This invention prepares toner particles by adding the region-B-particle dispersing liquid which contains 5 to 15 parts by weight of resin particles (b) to the region-A-particle dispersing liquid which contains 100 parts by weight of region-A particles and binding a layer of resin particles (b) of up to 1 μm thick to the surface of each region-A particle. "Binding of particles" means to couple region-A particles and region-B particles (b) which form region B by adhesion, adsorption, electrostatic coupling, or the like.

To assure bonding of resin particles (b) which form region B to the surface of each region-A particles without freeing the resin particles (b) in the dispersion liquid (except for phase separation), at least the polymeric monomers of region-A particles and region-B particles in the toner composition should be identical or similar.

(Toner Producing Process)

<<Producing Process for Forming the Region B to the Surface of Region-A Particles>>

The toner particles of this invention are prepared by bonding resin particles (b) to the surfaces of region-A particles to form region B and, to be more precise, by adding the region-(b) particle dispersing liquid part by part to the region-A particle dispersing liquid while heating and stirring the region-A particle dispersing liquid.

This process is followed by the steps of adding an aqueous solution of sodium chloride (prepared by dissolving a preset quantity of sodium chloride in 500 g of ion exchanged water) to the liquid mixture to weaken the coagulation force of the particles, keeping on stirring the liquid mixture until resin particles (b) are completely bonded to the region-A particles, cooling the liquid mixture, controlling the pH of the liquid mixture by dripping hydrochloric acid into the liquid mixture, and stopping stirring the liquid mixture. With this, the toner-particle dispersing liquid is prepared.

<<Solid-Liquid Separation and Toner-Cake Washing>>

This process separates toner particles (solid) as a toner cake from the above toner-particle dispersing liquid and washes the toner cake to remove the remaining surfactant and coagulant therefrom. Any solid-liquid separation method can be used here. Representative solid-liquid separation methods are a centrifugal separation method, a vacuum solid-liquid separation method using a Buchner funnel or the like, and a solid-liquid separation method using a filter press or the like. Similarly, any washing method can be used as long as it can remove the surfactant, coagulant, and other residuals from the toner cake.

<<Drying>>

This process dries up the washed toner cake. A spray dryer, a vacuum freeze dryer, and a vacuum dryer are available to this process. Preferable dryers are a fixed-shelf dryer, a mobile-shelf dryer, a fluidized-bed dryer, a rotary dryer, and a stirring type dryer. The water content of the dried toner particles should preferably be 5 mass percentages or less and more preferably 2 mass percentages or less. If the dried toner particles are bonded each other by weak intergranular forces, the toner lumps can be crashed by a mechanical crasher such as a jet mill or ejector.

<<Adding External Additives>>

The above prepared toner particles can be directly used as the toner of this invention, but it is preferable to add external additives to the prepared toner particles to improve the flow-ability and cleaning-ability. Specifically, it is preferable to use the particles whose primary grain size (D50) is 10 to 20 nm to give a flow-ability to the toner particles or the particles whose primary grain size (D50) is 20 to 30 nm to improve the transfer ability and to always clean image carriers in contact with the toner. Representative external additives available to this invention are organic fine particles (such as silica, low-resistance titanium, aluminum, and zinc oxide), organic fine particles, and lubricant.

Spherical fine organic particles of 10 to 2000 nm (in numeric average primary grain size) can be used as the external additives to the toner. Such organic particles are polystyrene, polymethylmethacrylate, and styrene-methylmethacrylate copolymers, etc. These external additives are effective to protect image carriers such as a photosensitive member and an intermediate transfer belt.

Lubricants available as the external additives to the toner are metallic salts of higher fatty acids such as metallic stearates (zinc stearate, aluminum stearate, copper stearate, magnesium stearate, and calcium stearate) and metallic palmitates (zinc palmitate, copper palmitate, magnesium palmitate, and calcium palmitate). Preferable fatty acid units are so-called saturated fatty acids which have no double bonds.

The quantity of external additives to be added should preferably be 0.1 to 5 mass percentages. The external additives can be added to the toner of this invention by a turbulence mixer, a Henschel mixer, a Nautor mixer, and a V-shaped mixer.

(Preparing a Developing Agent)

The toner of this invention can be used as a mono- or di-component developing agent. When the toner is used as a mono-component developing agent (e.g. magnetic mono-component developing agent), magnetic particles of 0.1 to 0.5 μm are added to a non-magnetic mono-component developing agent or toner.

It is more preferable to mix the toner of this invention with magnetic particles and use it as a di-component developing agent. Carriers used as magnetic particles can be selected from well-known materials such metals (e.g. iron, ferrite, and magnetite) and alloys of these metals and aluminum or lead. Among these materials, the ferrite particles are more preferable. The volumetric grain size (D50) of the magnetic particles should be 15 to 100 μm and preferably 25 to 80 μm.

The volumetric grain sizes (D50) of carriers can be measured typically by laser diffraction type grain size analyzer HELOS (by SYMPATEC) with a wet distributor.

It is preferable that the carriers (magnetic particles) are further coated with resin or of the resin-dispersion type (which disperses magnetic particles in resin). Any resin can be used to coat the magnetic particles. Resins available for resin coating are, for example, olefin resin, styrene resin, styrene-acrylic resin, silicone resin, ester resin, and fluorine-containing polymer resin. Further, any well-known resin can be used to form the resin-dispersion type carriers. Such resins are, for example, styrene-acrylic resin, polyester resin, fluorocarbon resin, and phenol resin.

Next will be explained an image forming method using the toner of this invention.

Any image forming method can use the toner of this method. A preferable means for fixing the toner of this invention should be so constructed to move a transfer sheet between a pressure roller and a heating roller, between a belt and a heating roller, or between a soft roller and a heating roller to fix a toner image.

With the above fixing means, the toner of this invention can be fixed fast with less heat and form a preferable toner image on any kind of recording medium such as a piece of thin paper, coated paper or cardboard.

The temperature of the heating roller should be set, for example, to 100 to 150° C. so that the surface temperature of the transfer material may be 80 to 98° C. Use a non-contact thermometer or a label which is coated with a heat-sensitive paint to measure the surface temperature of the transfer material. The nip area width of the heating roller should be 8 to 40 mm and preferably 11 to 30 mm.

The heating roller can be coated with silicone oil (at a rate of 0.3 mg or less per print) or without the oil.

[Fixing by a Heating Roller]

Figure 2:
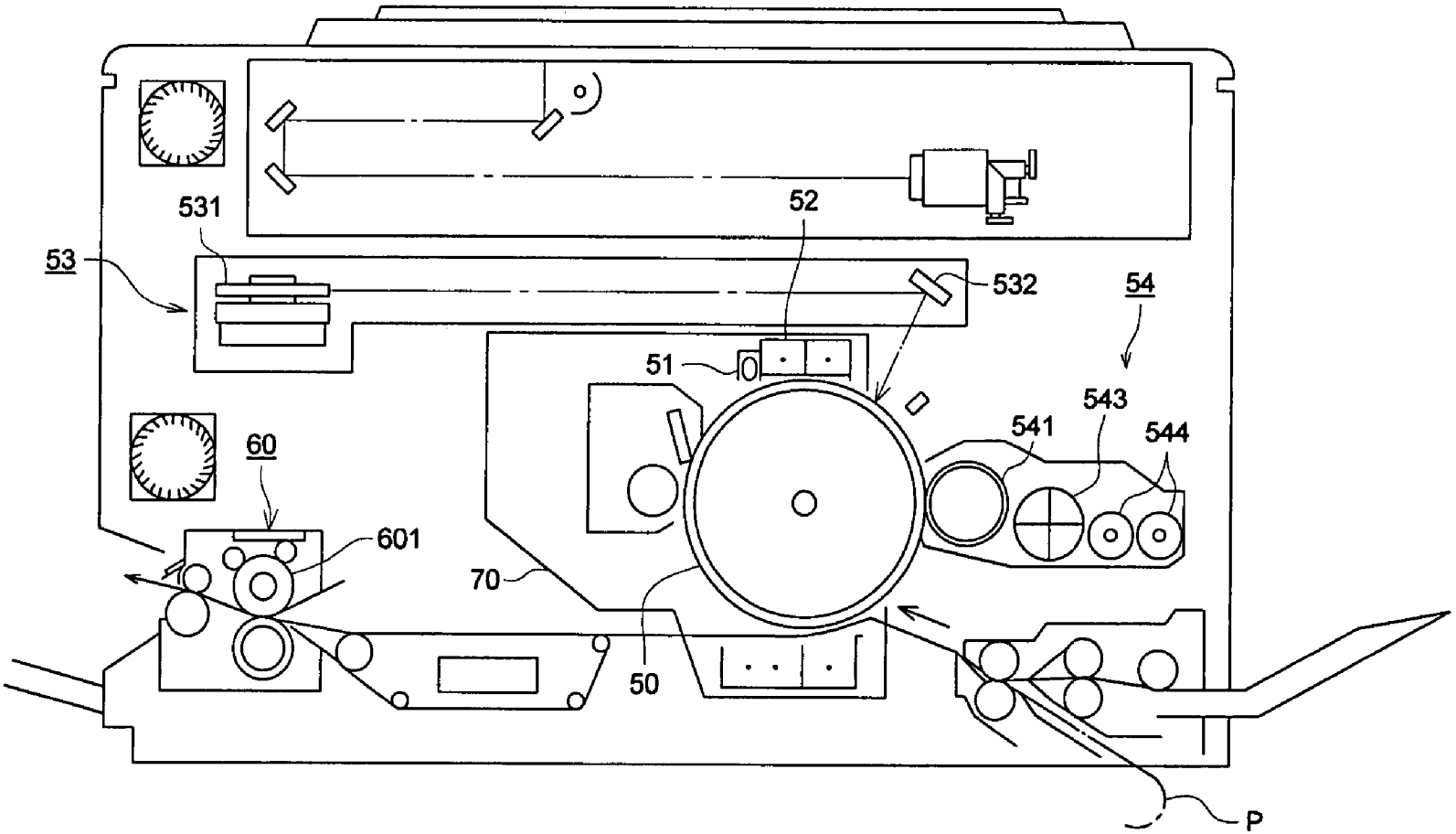
FIG. 2 shows a simplified sectional view of an example of image forming apparatus (of the heat fusing type using a thermal fixing roller) which is used by the image forming method of this invention.

FIG. 2 shows a simplified sectional view of an example of image forming apparatus (of the heat fusing type using a thermal fixing roller) which is used by the image forming method of this invention.

In FIG. 2, photosensitive drum 50 (or a photosensitive member) for carrying an image is coated with an organic photosensitive layer and a resin layer in this order (from the inner side to the outer surface of the drum). This drum is grounded and rotated clockwise. Scorotron type charger 52 (or a charging means) gives an even charge to the whole circumferential surface of the photosensitive drum by corona discharging. To eliminate the image hysteresis on the photosensitive material by charge neutralization, it is preferable to apply light to the circumferential surface of the photosensitive drum by pre-charging exposure section 51 (which is equipped with light-emitting diodes) before charging the photosensitive drum by charger 52.

After an even charge is given to the photosensitive drum, image exposure 53 as an image exposing means exposes the drum according to an image signal. The image exposure (53) has a laser diode as an exposing light source. The laser light has its light path changed by polygon mirror 531, lens fθ, and mirror 532 to scan the photosensitive drum and form an electrostatic latent image on the photosensitive drum.

After the photosensitive drum is evenly charged and exposed by charger 52, the developing process (means) makes the latent image (exposed area) visible on the photosensitive drum. The unexposed area (potential) is not developed by a developing bias potential which is applied to developing sleeve 54.

Next, the latent image is developed by developer 54 (as a developing means) which is provided along the circumference of photosensitive drum 50 and contains a developing agent made of a toner and a carrier. The developing is made by a developing sleeve (54) which rotates while holding the developing agent on it by a magnet means. Developer 54 contains members 544 and 543 which agitates and delivers the developing agent and member which regulate the quantity of the developing agent to be delivered. The developing agent is agitated and delivered to the developing sleeve and its feeding rate is controlled by member 541. The feeding rate is dependent on the linear speed of the organic electrophotographic sensitive drum and the specific gravity of the developing agent, but it usually is 20 to 200 mg/cm$^2$.

The toner of this invention can be used as a di- or mono-component developing agent. The developing sleeve (or the developing roller) should be 20 to 5 mm in diameter and preferably 18 to 7 mm in diameter. The linear speed of the developing sleeve should preferably be 200 to 1800 mm/sec.

Removable process cartridge 70 is equipped with a photosensitive drum, a charger, a transfer unit, a separator, and a cleaner in a body. Since the toner of this invention is fit for fast developing by a small developer whose roller diameter is in the above range, it is preferably used by a process cartridge type image forming apparatus.

[Belt Fixing]

Figure 3:
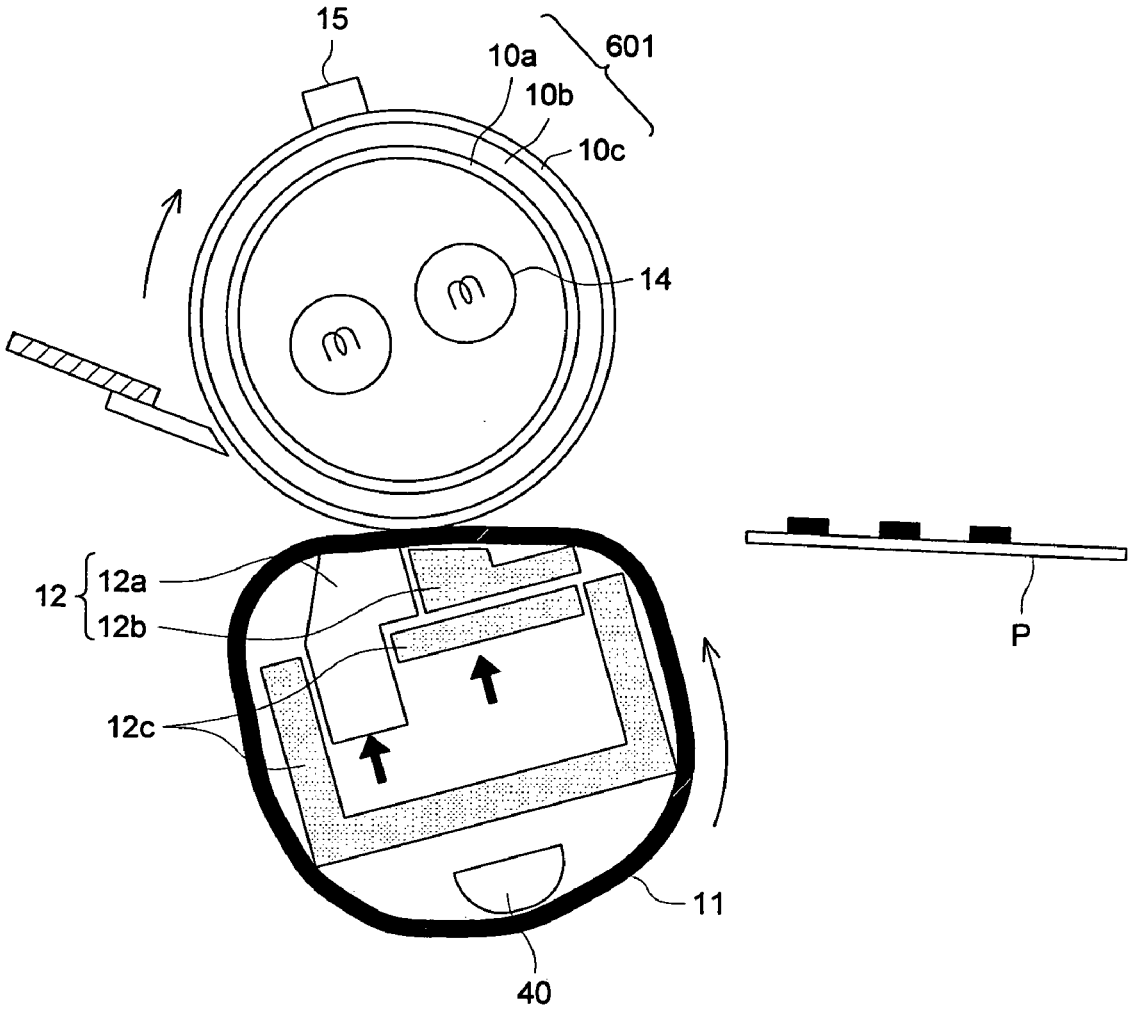
FIG. 3 shows a schematic view of an example of a fixing device which is equipped with a belt and a heating roller to secure a wide nip area.

FIG. 3 shows a schematic view of an example of a fixing device 60 which is equipped with a belt and a heating roller to secure a wide nip area.

In FIG. 3, the developing device is mainly equipped with fixing roller 601, seamless belt 11, pressure pads (members) 12*a* and 12*b* which are pressed against the fixing roller with the seamless belt therebetween, and lubricant supplier 40.

The fixing roller (601) is made of a metallic core (a cylindrical core), a heat-resistant elastic layer 10*b* which coats the core surface, and release layer 10*c* (a heat-resistant resin layer) which coats the outer surface of elastic layer 10*b*. The core (10*a*) houses halogen lamps 14 as a heat source. The surface temperature of the fixing roller (601) is measured by temperature sensor 15 and controlled to a preset temperature level by a temperature controller (not shown in the drawing). The temperature controller controls the power of the halogen lamps. (14) according to a signal from the temperature sensor (15). The seamless belt (11) is in contact with a preset area of the fixing roller (601) to form a nip area.

The pressure pad (12) coated with a low-friction layer is provided inside the seamless belt (11) so as to press the seamless belt (11) against the surface of the fixing roller (601). Pad holder 12*c* made of metal or the like is provided to hold pressure pad 12*a* which give a strong nipping force and pressure pad 12*b* which give a weak nipping force.

Further, the pad holder (12*c*) is equipped with a belt guide to run the seamless belt (11) smoothly. The belt guide should preferably be made of a low-friction and low-heat-conductive material to run the belt smoothly without depriving the belt of heat.

[Fixing by a Soft Roller]

Figure 4:
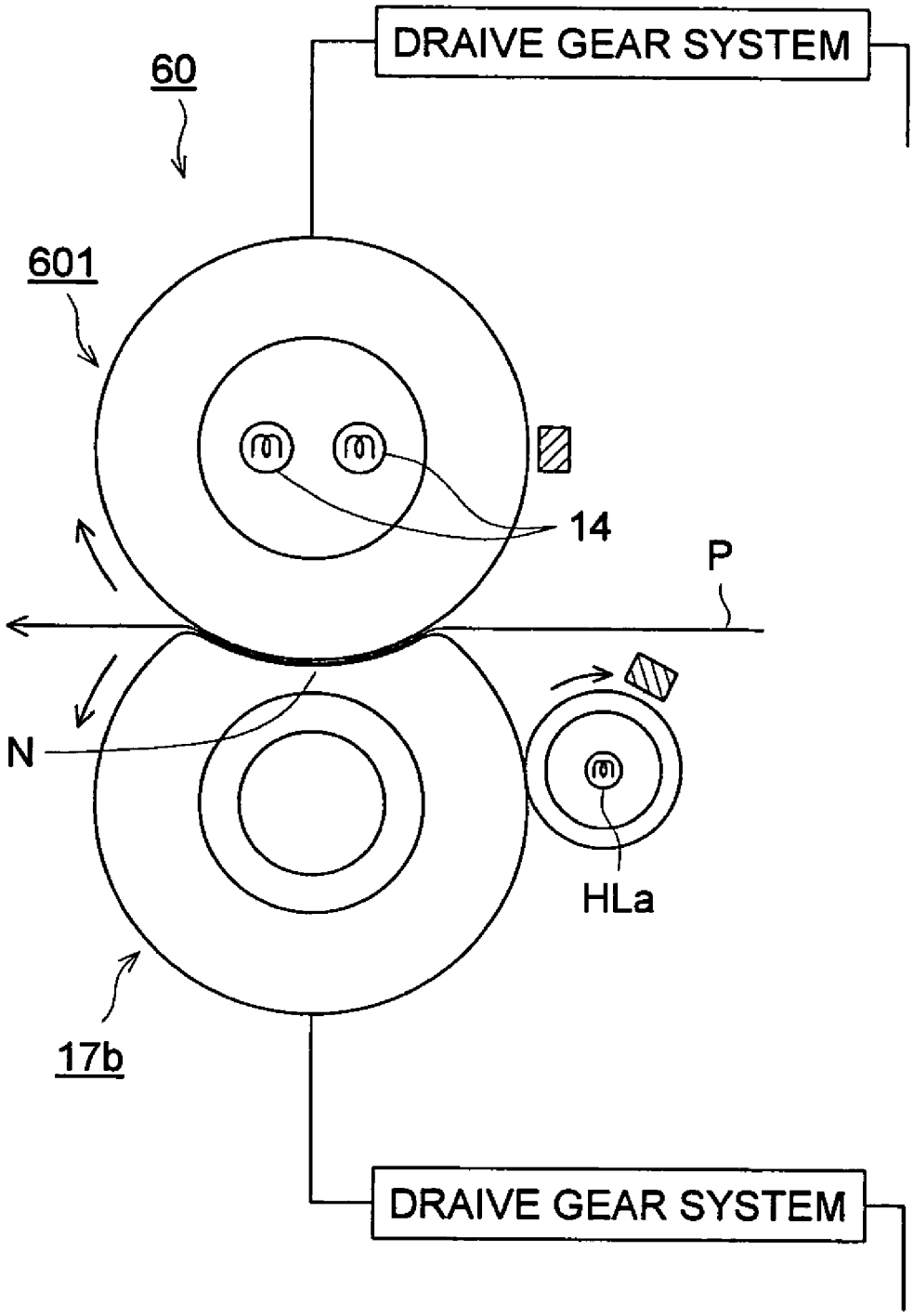
FIG. 4 shows a schematic view of an example of a fixing device which is equipped with a soft roller and a heating roller to secure a wide nip area, prevent a transfer material from twining around the roller, and form excellent images.

FIG. 4 shows a schematic view of an example of a fixing device 60 which is equipped with a soft roller and a heating roller to secure a wide nip area, prevent a transfer material from twining around the roller, and form excellent images.

As shown in FIG. 4, fixing device 60 of this invention is equipped with heating roller 601 as a heating roller member, soft roller 17*b* as a soft roller member, and halogen lamps 14 inside the heating roller (601) as a heating member.

This fixing device forms nip section N between the heating roller (601) and the soft roller (17*b*) and applies heat and pressure to the transfer material (P) in the nip section to fix a toner image to the transfer material (P). It is possible to provide a halogen lamp (14, not shown in the drawing) as a heating member inside the soft roller (17*b*).

The transfer material available to this invention is a member to hold a toner image and usually called a normal image support, transfer material, or transfer paper. Specifically, such transfer materials are plain paper (including thin paper and cardboard), printing paper (art paper and coated paper), commercially-available Japanese paper and postcard paper), plastic films for OHP, cloths, etc. However, the transfer material of this invention is not limited to these.

EXAMPLES

In the following examples are described several preferred embodiments to illustrate the invention. However, it is to be understood that the invention is not intended to be limited to the specific embodiments.

1. Preparation of Resin Particles (b) which Form Region-B

<Preparation of Resin Particles (b1)>

A polymeric monomer solution (b1-1) of the composition below was prepared below.

| | |
|---|---|
| 2-ethylhexylacrylate | 15.5 parts |
| Styrene | 50.0 parts |
| Methylmethacrylate | 3.5 parts |
| Methacrylic acid | 31.0 parts |

A mixture of 7.08 grams of anionic surfactant (Compound 102: $C_{12}H_{25}OSO_3Na$) and 3010 grams of ion-exchanged water in a 5000 ml separable flask equipped with a stirrer, a temperature sensor, a cooling tube, and a nitrogen gas feeder, was stirred in the presence of nitrogen gas at 80° C. An aqueous surfactant solution was obtained.

An initiator solution by dissolving 9.2 grams of polymerization initiator (potassium persulfate KPS) in 200 grams of ion-exchanged water was put into the above aqueous surfactant solution. Then the mixture was heated to 75° C. The above polymeric monomer solution (b1-1) was dripped into the mixture gradually in one hour, and kept on heating and stirring this mixture for 2 hours at 75° C. for polymerization (after completing the dripping of the polymeric monomer solution). With this, resin particles which are the raw material of resin region B were obtained. Herein after the resin particles is called "resin particles (b1)." Its SP value and glass-transition temperature (Tg) are respectively 9.77 and 61.0° C.

<Preparation of Reference Resin Particles (b2)>

There was prepared reference resin particles (b2) using the polymeric monomer solution (b1-1) of the composition below in the same process as the preparation of resin particles (b1).

| | |
|---|---|
| Styrene | 71.0 parts |
| n-butylacrylate | 20.5 parts |
| Methacrylic acid | 8.5 parts |

The SP value and glass-transition temperature (Tg) of resin particles (b2) are respectively 10.37 and 59.3° C.

2. Preparation of Resin Particles (a) which Form Region-A 2-1) Preparation of Resin Particles (a1)

There were prepared resin particles (a1) which form region-A of mother-body resin particles in 2 polymerization steps (2-stage polymerization).

There was put 96.0 parts of release agent (Compound 19) into the polymeric monomer mixture below in the flask equipped with a stirrer, heated the mixture to 80° C. to dissolve the agent. There was called the obtained solution "Polymeric monomer solution (2-1-1)."

Compound 19

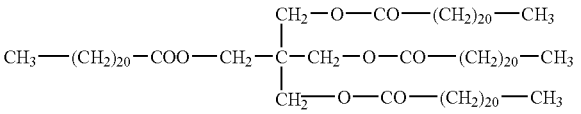

<Polymeric Monomer Solution (2-1-1)>

| | |
|---|---|
| Styrene | 6.7 parts |
| n-butylacrylate | 2.5 parts |
| Methacrylic acid | 0.9 parts |

There was put 2.5 parts of anionic surfactant (Compound 101) and 1340 parts of ion-exchanged water in a separable flask equipped with a stirrer, a temperature sensor, and a cooling tube, dissolved the surfactant in the solution, and thus obtained an aqueous surfactant solution.

Compound 101: $C_{12}H_{25}(OCH_2CH_2)_2OSO_3Na$

There was heated the aqueous surfactant solution to 80° C., dispersed the polymeric monomer solution (2-1-1) for 2 hours by a mechanical dispersing machine CLEARMIX (by M Technique) having a circulation path, and obtained an emulsified solution which contains emulsified particles (oil drops) of 482 nm in diameter.

There was added 1460 parts of ion-exchanged water to the solution, added an initiator solution (prepared by dissolving 7.5 parts of potassium persulfate KPS in 142 parts of ion-exchanged water) and 6.74 parts of n-octanethiol to the mixture, and stirred the mixture at 80° C. for 3 hours (for the first polymerization). There was got a dispersion liquid of resin particles (of high molecular weight). Herein after the resin particles are called "Resin particles (a1-1) which form resin region-A."

There was added an initiator solution (prepared by dissolving 11.6 parts of potassium persulfate KPS in 220 parts of ion-exchanged water) to the dispersion liquid of resin particles, and dripped the polymeric monomer solution (2-1-2) below into the mixture gradually in one hour at 80° C.

<Polymeric Monomer Solution (2-1-2)>

| | |
|---|---|
| Styrene | 58.3 parts |
| n-butylacrylate | 35.0 parts |
| Methacrylic acid | 6.5 parts |
| Poly-1-butene (of numeric average molecular weight of 2000) | 4.0 parts |

There was kept on heating and stirring this mixture for 2 hours at 80° C. (for the second polymerization) (after completing the dripping of the polymeric monomer solution), cooled the mixture down to 28° C., and obtained a dispersion liquid of resin particles (a1) which uses resin particles (a1-1) as the raw material. Its SP value and glass-transition temperature (Tg) are respectively 10.25 and 30.0° C.

2-2) Process of Forming Resin Region A (Coagulation Process)

There was mixed a colorant dispersion liquid below and the above dispersion liquid of resin particle (a1) and coagulated the colorant particles and resin particles (a1).

(Preparation of a Colorant Dispersion Liquid)

There was dissolved 59.0 parts of anionic surfactant (Compound 101) in 1600 ml of ion exchanged water, gradually added 420.0 parts of carbon black (LEGAL 330) into the mixture while stirring the mixture, dispersed the mixture by CLEARMIX (by M Technique), and obtained a dispersion liquid of colorant particles. The grain size of the particles (D50) in the colorant dispersion liquid is 93 nm.

<Coagulation Process>

A mixture of a dispersion liquid including the resin particle (a1) being 300.0 parts (equivalent to solids), 1120 parts of ion-exchanged water, and 237 parts of the colorant dispersion liquid in a 4-neck flask equipped with a temperature sensor, a cooling tube, a nitrogen gas feeder, and a stirrer, were stirred in the presence of nitrogen gas, kept the liquid temperature at 30° C. An aqueous sodium hydroxide solution of 5 moles/liter was added to the mixture until the pH of the solution reached 10.

Next, There was dissolved 55.3 parts of magnesium chloride hexahydrate in 55.3 ml of ion-exchanged water, added this solution to the above mixture gradually in 10 minutes at 30° C., left the mixture still for 3 minutes, and heated the mixture up to 90° C. in 60 minutes. With this, there was coagulated the mother-body resin particles (2-1-2) and the colorant particles.

There were measured the grain sizes of coagulated particles by Coulter Counter TA-II (by Beckman Coulter) while heating and stirring the mixture and added an aqueous solution of sodium chloride (prepared by dissolving 15.3 parts of sodium chloride in 100 ml of ion-exchanged water) to the mixture when the volumetric average grain size of the coagulated particles became 5.5 μm to stop growth of the particles.

3. Process of Bonding Resin Particles (b) to Resin Region-A 3-1) Dispersion Liquid of Toner Particles 1

There was prepared a resin particle dispersion liquid including the resin particle (b1) being 60 grams (equivalent to solid) of pH 8 by adding an aqueous sodium chloride solution of 5 moles per liter.

Meanwhile, there was kept on heating and stirring the dispersion liquid of resin region A for at least one hour, and added each one fourth of the resin particle dispersion liquid (in four divided parts) to the dispersion liquid of resin region A when the circularity of particles becomes 0.936. With this, there was bonded resin particles (b) to the surface of resin region A and formed resin region-B around resin region-A.

There was added an aqueous solution of sodium chloride (prepared by dissolving 123.9 parts of sodium chloride in 500 parts of ion exchanged water) to the liquid mixture to weaken the coagulation force of the particles, kept on stirring the liquid mixture at 95° C. for 2 hours until resin particles (b1) were completely bonded to resin region-A, kept on stirring the mixture at the temperature, cooled the mixture down to 30° C. at a rate of 8° C. per minute, controlled the pH of the mixture to 2 by dripping hydrochloric acid into the liquid mixture, and stopped stirring the mixture. Herein after this liquid was called "Dispersion liquid of toner particles 1."

3-2) Dispersion Liquid of Toner Particles 2

There was prepared a dispersion liquid of toner particles 2 in the same process of 3-1) except that the amount of the added (b1) was changed from 60 grams to 15 grams of equivalent to solid.

3-3) Dispersion Liquid of Toner Particles 3

There was prepared a dispersion liquid of toner particles 3 in the same process of 3-1) except that the amount of the added (b1) was changed from 60 grams to 120 grams of equivalent to solid.

3-4) Dispersion Liquid of Toner Particles 1 for Comparison

There was prepared a dispersion liquid of toner particles 1 for comparison in the same process of 3-1) except of using a resin particle dispersion liquid including the resin particle (b2) being 60 grams (equivalent to solid) instead of the resin particle dispersion liquid including the resin particle (b1) being 60 grams (equivalent to solid).

3-5) Dispersion Liquid of Toner Particles 2 for Comparison

There was prepared a dispersion liquid of toner particles 2 for comparison in the same process of 3-4) except that a dispersion liquid including the resin particle (b1) being 300.0 parts (equivalent to solids) is used instead of a dispersion liquid including the resin particle (a1) being 300.0 parts (equivalent to solids) in the coagulation process and that the resin particle dispersion liquid including the resin particle (a1) being 60 grams (equivalent to solid) is used instead of the resin particle dispersion liquid including the resin particle (b1) being 60 grams (equivalent to solid). The toner particles 2 for comparison reverse resin regions A and B of the toner particles 1.

4. Solid-Liquid Separation and Toner-Cake Washing

This process centrifugally separates toner particles (solid) as a toner cake from respective toner-particle dispersion liquids and washes the toner cake while sprinkling ion-exchanged water of 40° C. over the toner cake.

5. Drying

There was dried each washed toner cake by warm wind of 40° C. from a spray dryer until the water content of the dried toner cake is 2 mass percentages or less and obtained toner particles 1 to 3 and comparative toner particles 1 and 2 for comparison.

Table 1 lists characteristics of the above toner particles.

TABLE 1

| | Does region-B exist in a surface layer of up to 1 μm thick? | Thick-ness of region B on the toner particle surface (μm) | Ratio of region B on the toner particle surface (%) | Region B SP value | Region B Tg (° C.) | Region A SP value | Region A Tg (° C.) | Re-marks |
|---|---|---|---|---|---|---|---|---|
| toner particle 1 | Exists | 0.3 to 0.4 | 94.3 | 9.77 | 61.0 | 10.25 | 30.0 | See FIG. 1 (a) |
| toner particle 2 | Exists | 0.3 to 0.4 | 76.4 | 9.77 | 61.0 | 10.25 | 30.0 | See FIG. 1 (a) |

TABLE 1-continued

| | Does region-B exist in a surface layer of up to 1 μm thick? | Thick-ness of region B on the toner particle surface (μm) | Ratio of region B on the toner particle surface (%) | Region B SP value | Region B Tg (° C.) | Region A SP value | Region A Tg (° C.) | Re-marks |
|---|---|---|---|---|---|---|---|---|
| toner particle 3 | Exists | 0.8 to 2.5 | 100 | 9.77 | 61.0 | 10.25 | 30.0 | See FIG. 1 (b) |
| Compar-ative toner particle 1 | Not exist | 0 | 0 | 10.37 | 59.3 | 10.25 | 30.0 | |
| Compar-ative toner particle 2 | Not exist | 0 | 0 | 10.37 | 59.3 | 10.25 | 30.0 | |

6. Adding Additives

There was added 1 mass percentage of hydrophobic silica particles (numeric average primary grain size of 12 nm and degree of hydrophobicity of 68) and 1 mass percentage of hydrophobic titanium oxide particles (numeric average primary grain size of 20 nm and degree of hydrophobicity of 63) to each of the above toner particles (Toner Particles 1 to 3 and Comparative Toner Particles 1 and 2), mixed them up by HENSCHEL MIXER (by Mitsui Miike Chemical Engineering), sieved away bigger particles with a 45-μm sieve, and thus prepared Toners 1 to 3 and Comparative Toners 1 and 2.

7. Preparing Developing Agents

There was prepared Developing Agents 1 to 3 and Comparative Developing Agents 1 and 2 by adding silicone-coated ferrite carrier particles of 60 μm in volumetric grain size (D50) to each of the above prepared toner particles (Toner Particles 1 to 3 and Comparative Toner Particles 1 and 2) so that the concentration of the toner particles might be 6 mass percentages.

<<Forming Printed Images>>

There was employed a commercially available multifunction electrophotographic printer Sitios 7035 (by Konica Minolta), changed the linear speed of the printer to 280 mm/sec (equivalent to approx. 50 sheets per minute), replaced the existing roller by a smaller developing roller (9 mm in diameter) and the existing fixing device by a fixing device of FIG. 3 (which uses a polyimide seamless belt as the fixing and pressing member), and made a print copy. Then there was evaluated the internal status of the printer and the printed images in terms of the check items below.

(Charging Speed)

There were made 1000 copies of images of 75% in pixel ratio in a Print mode which required quite a lot of toner supply and consumption and checked the inside of the printer for toner contamination and the copies for insufficient toner quantities.

Criterion

A: No toner spattering due to insufficient charging and no image blurring

B: No toner spattering due to insufficient charging but slight image blurring on the trailing end of the copy (Practically Acceptable)

D: Some toner spattering due to insufficient charging and unacceptable image blurring (Charge Retaining Ability of Toner Particles)

There was left the printer in a hot and moist environment (30° C. and 90% RH) for 72 hours, then made image copies under the previous developing condition, and evaluated the printed images by eyes.

Criterion

A: Good tone reproduction

B: Reduced shade (half tone) Photo images seem to be dark but are practically acceptable.

D: 3-point characters such as letter "e" are hard to be recognized.

(Heat Resistance and Anti-Coagulation of Toner in Storage)

There were kept respective toners (100 grams) at 55° C. and 90% RH for 24 hours, sieved the toner with a 45-μm sieve, measured the weight of bigger (coagulated) particles left on the sieve, and calculated the ratio (by weight) of the bigger toner particles left on the sieve to the weight (100 grams) of respective toner. There was evaluated the heat resistance and anti-coagulation of toner in storage by this ratio.

Criterion

A: The ratio (by weight) of the coagulated toner particles left on the sieve is less than 5%. This means that the toners are stable and hardly coagulated during storage. (This also means that the toners can be transported safely without any heat-insulating package in summer.)

B: The ratio (by weight) of the coagulated toner particles left on the sieve is 5 to 30%. This means that the toners are stable and less coagulated during storage. (This also means that the toners can be transported safely in paper cartons in summer.)

D: The ratio (by weight) of the coagulated toner particles left on the sieve is more than 30%. This means that the toners are much coagulated during storage and practically unacceptable. (This also means that the toners must be cooled during delivery.)

<Lowest Fixing Temperature>

There was controlled the surface temperature of the heating roller in the fixing device of the above printer so that the surface temperature of paper might vary at intervals of 10° C. in the range of 80 to 150° C., and fixed toner images on A4-size bond paper (80 g/cm$^2$) at respective test temperatures (80, 90, 100, . . . , 150° C.).

There was evaluated the fixing strength (fixing ratio) of images fixed to paper by a method conforming to the "Peeling by Mending Tape" method defined by "Basics and Applications of Electrophotography by The Society of Electrophotography of Japan" Chapter 9, Section 1.4.

Specifically, there was printed a solid black pattern of 2.54 cm square which requires toner of 0.6 mg/cm$^2$, measured the image densities before and after the image is peeled off by Sumitomo 3M Mending Tape, and calculated the ratio of image density that remained on the paper.

The lowest fixing temperature is defined as the surface temperature of a transfer sheet (paper) whose fixing ratio is 95% or more. The surface temperature of a transfer sheet (paper) was measured by a non-contact thermometer. The image density was measured by a reflection densitometer RD-918 (by Macbeth).

Criterion

A: Can be fixed at lower than 95° C. (the lowest fixing temperature).

B: Can be fixed at 95° C. (the lowest fixing temperature) to 120° C. (not including 120° C.).

D: Can be fixed at 120° C. (the lowest fixing temperature) or higher.

<Wrinkles on Thin Paper>

There were made 20 copies of a solid image on A4-size thin paper (40 g/cm$^2$) and checked the printed sheets for wrinkles by eyes.

Criterion

A: No wrinkled sheet

B: One or less wrinkled sheet

D: Two or more wrinkled sheets

<Image Failure on Glossy Coated Paper>

There was made 20 copies of a solid image on A4-size glossy coated paper (75 g/cm$^2$, Mitsubishi Super Art) and counted white spots of 1 mm or bigger in diameter in each solid image. There were evaluated the image failures by the number of white spots.

Criterion

A: No white spot in a solid image

B: 1 to 3 white spots of 1 mm or bigger on average in a solid image

D: More than 3 white spots of 1 mm or bigger on average in a solid image

Table 2 lists up the results of evaluation of Toner Particles 1 to 3 (Examples 1 to 3) and Comparative Toner Particles for Comparison 1 and 2 (Comparative examples 1 and 2).

TABLE 2

| | Charging speed | Charge retaining ability | Heat resistance and storage stability | Lowest fixing temperature | Wrinkles on thin paper | Image failure on glossy coated paper |
|---|---|---|---|---|---|---|
| Example 1 | A | A | A | A | A | A |
| Example 2 | A | B | B | A | A | A |
| Example 3 | B | A | A | B | B | B |
| Comparative example 1 | D | D | D | B | B | B |
| Comparative example 2 | D | D | D | B | B | B |

As evidenced by Table 2, Toner Particles 1 to 3 (Embodiments 1 to 3) are excellent in every test items but Toner Particles for Comparison 1 and 2 are inferior to the Toner particles 1 to 3 in some of the test items.

What is claimed is:

1. A toner comprising toner particles each containing a resin and a colorant, wherein the toner particle has:

a region A which contains the colorant and a region B through which more electrons can pass than the region A, the region A is covered by the region B and the region A is within 1 μm deep from a circumference of the toner particle, when the toner particle is observed in a state of a microscopic segment having a thickness of 80 to 200 nm through a transmission electron microscope at an acceleration voltage of 80 kV, the region A comprises a resin derived from styrene or its derivative monomer, the region B comprises a resin made of 2-ethylhexyl acrylate, the region A is made of a different resin than the region B, a solubility parameter value of the resin in the region B is lower than that of the resin in the region A and the difference between the solubility parameter values is 0.2 to 0.8, and the region A is prepared by emulsifying polymerization to obtain the resin and salting out and bonding of the resin.

2. The toner of claim 1, wherein the resin in region A has a solubility parameter value of 10.0 to 10.5, and a resin in the region B has a solubility parameter value of 9.5 to 10.0, and the difference between the solubility parameter values is 0.3 to 0.7.

3. The toner of claim 1, wherein the resin in the region B has a glass-transition temperature of 50 to 65° C., and the resin in the region A has a glass-transition temperature of −20 to 39° C., wherein the surface of the toner particle is covered by region B in its area of 40 to 100%, wherein the resin in region A has a solubility parameter value of 10.0 to 10.5, and the resin in the region B has a solubility parameter value of 9.5 to 10.0 and wherein the resin in region B is derived from at least one of (meth)acrylate, 2-ethyl hexyl acrylate, diacrylic ester of hexamethylene glycol, and diacrylic ester of behenyl glycol.

4. The toner of claim 1, wherein the resin in region B has a glass-transition temperature of 50 to 65° C., and the region A contains a mixture of a fixing assistant and the resin, and the resin in region A has a glass-transition temperature temperature of −20 to 39° C.

5. The toner of claim 4, wherein the resin in the region B has the glass-transition temperature 40 to 80° C. higher than that of the resin in region A.

6. The toner of claim 1, wherein the region B covers a surface of the region A in its area of 40 to 100%.

7. The toner of claim 1, wherein the resin in region A has a solubility parameter value of 10.0 to 10.5, and the resin in the region B has a solubility parameter value of 9.5 to 10.0.

8. The toner of claim 1, wherein the resin in the region A has molecular weight of 15,000 to 25,000 and the resin in region B has molecular weight of 10,000 to 35,000 by the gel-permeation chromatography (GPC) which uses tetrahydrofuran (THF) as the column solvent.

9. The toner of claim 1, having softening point of 75 to 98° C.

10. A method for producing a toner comprising toner particles each containing a resin and a colorant, the method comprising: preparing a region A which contains the colorant; and forming region B on the region A, wherein a solubility parameter value of the resin in the region B is lower than that of resin in the region A and the difference between the solubility parameter values is 0.2 to 0.8 and the resin in the region B contains vinyl polymer having an alkyl group or alkylene group of 6 to 20 carbons which can branch.

11. The method of claim 10, wherein the region B contains the resin having a glass-transition temperature of 50 to 65° C., and the region A contains a mixture of a fixing assistant and the resin having the glass-transition temperature of −20 to 39° C.

12. An image forming method comprising:

forming a latent image on an electrophotographic photoreceptor;

developing the latent image with a toner of claim 1 to form a visible toner image;

transferring the toner image onto a transferring material;

heating the surface of the transferring material to 80 to 105° C.; and fixing the toner image on the transferring material.

13. The method of claim 12, wherein a solubility parameter value of a resin in the region B is lower than that of a resin in the region A and the difference between the solubility parameter values is 0.2 to 0.8.

14. The method of claim 12, wherein a resin in the region B contains vinyl polymer having an alkyl group or alkylene group of 6 to 20 carbons which can branch.

15. The method of claim 12, wherein the region B contains a resin having a glass-transition temperature of 50 to 65° C., and the region A contains a mixture of a fixing assistant and a resin having the glass-transition temperature of −20 to 39° C.

16. The method of claim 12, wherein a resin in the region B has the glass-transition temperature 40 to 80° higher than that of a resin in region A.

* * * * *